US011468845B2

(12) United States Patent
Kim et al.

(10) Patent No.: US 11,468,845 B2
(45) Date of Patent: Oct. 11, 2022

(54) SCAN DRIVER AND A DISPLAY DEVICE INCLUDING THE SAME

(71) Applicant: SAMSUNG DISPLAY CO., LTD., Yongin-si (KR)

(72) Inventors: Sung Hwan Kim, Yongin-si (KR); Eun Ju Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/172,375

(22) Filed: Feb. 10, 2021

(65) Prior Publication Data

US 2022/0013078 A1 Jan. 13, 2022

(30) Foreign Application Priority Data

Jul. 7, 2020 (KR) ..... 10-2020-0083646

(51) Int. Cl.
*G09G 3/3266* (2016.01)
*G09G 3/36* (2006.01)

(52) U.S. Cl.
CPC ..... *G09G 3/3266* (2013.01); *G09G 3/3688* (2013.01); *G09G 3/3696* (2013.01); *G09G 2310/0286* (2013.01); *G09G 2310/0289* (2013.01); *G09G 2310/0291* (2013.01); *G09G 2310/08* (2013.01)

(58) Field of Classification Search
CPC .. G09G 3/3696; G09G 3/3266; G09G 3/3688; G09G 2310/0291; G09G 2310/0289; G09G 2310/08; G09G 2310/0286
See application file for complete search history.

(56) References Cited

U.S. PATENT DOCUMENTS

| | | | | |
|---|---|---|---|---|
| 9,378,696 | B2 * | 6/2016 | Yao | G09G 3/3677 |
| 9,418,755 | B2 * | 8/2016 | So | G09G 3/3677 |
| 9,966,032 | B2 * | 5/2018 | Liu | G09G 3/3688 |
| 10,276,121 | B2 * | 4/2019 | Kim | G09G 3/3696 |
| 10,311,795 | B2 * | 6/2019 | Chen | G11C 19/28 |

(Continued)

OTHER PUBLICATIONS

Binn Kim et al., "A novel depletion mode a-IGZO TFT shift register with a node shared structure", IEEE Electron Device Letters, vol. 33, No. 7, pp. 1003-1005, Jul. 2012.

(Continued)

*Primary Examiner* — Michael J Jansen, II
(74) *Attorney, Agent, or Firm* — F, Chau & Associates, LLC

(57) ABSTRACT

A scan driver including a stage that includes: an input circuit controlling a voltage of a first node in response to signals at first and second input terminals; a first signal processing circuit controlling a voltage of a second node in response to the signal at the first input terminal and supplies a voltage of a first power to the second node in response to the signal at the second input terminal; a second signal processing circuit supplying a voltage of a second power to the first node in response to a signal at a third input terminal and the voltage of the second node; a first output circuit outputting the signal at the third input terminal as a first scan signal; and a second output circuit outputting a signal at a fourth input terminal as a second scan signal at a different time from the first scan signal.

20 Claims, 6 Drawing Sheets

(56) References Cited

U.S. PATENT DOCUMENTS

| | | | | |
|---|---|---|---|---|
| 10,930,360 | B2 * | 2/2021 | Liu | G09G 3/20 |
| 10,943,552 | B2 * | 3/2021 | Kim | G09G 3/20 |
| 10,950,322 | B2 * | 3/2021 | Fan | G09G 3/20 |
| 11,107,381 | B2 * | 8/2021 | Wang | G09G 3/3677 |
| 2007/0146289 | A1 * | 6/2007 | Lee | G11C 19/184 345/100 |
| 2008/0266275 | A1 * | 10/2008 | Tsai | G09G 3/3677 345/204 |
| 2011/0002438 | A1 * | 1/2011 | Kim | G11C 19/28 377/67 |
| 2011/0058642 | A1 * | 3/2011 | Tsai | G11C 19/28 377/79 |
| 2014/0152629 | A1 * | 6/2014 | So | G09G 3/3266 345/205 |
| 2015/0077319 | A1 * | 3/2015 | Yao | G09G 3/20 345/100 |
| 2017/0193957 | A1 * | 7/2017 | Liu | G11C 19/28 |
| 2018/0182300 | A1 * | 6/2018 | Chen | G11C 19/28 |
| 2019/0206294 | A1 * | 7/2019 | Tian | G11C 19/28 |
| 2019/0333597 | A1 * | 10/2019 | Liu | G11C 19/287 |
| 2020/0258463 | A1 * | 8/2020 | Kim | G09G 3/3677 |
| 2021/0134203 | A1 * | 5/2021 | Wang | G09G 3/3677 |

OTHER PUBLICATIONS

Y. Kim et al., "Node sharing low temperature poly silicon TFT shift register without bootstrapping degradation for harrow bezel displays", Electronic Letters, Oct. 4, 2018 vol. 54, No. 20, pp. 1162-1164.

Hyung Nyuck Cho et al., "Amorphous silicon gate driver circuits of shared node dual pull down structure with overlapped output signals", Journal of SID, pp. 77-81, 16/1, 2008.

* cited by examiner

SCAN DRIVER AND A DISPLAY DEVICE INCLUDING THE SAME

CROSS-REFERENCE TO RELATED APPLICATION

This application claims priority under 35 U.S.C. 119 to Korean Patent Application No. 10-2020-0083646 filed in the Korean Intellectual Property Office on Jul. 7, 2020, the disclosure of which is incorporated by reference herein in its entirety.

TECHNICAL FIELD

The present invention relates to a display device. More particularly, the present invention relates to a display device including a scan driver.

DESCRIPTION OF THE RELATED ART

A display device is an output device for presentation of information in visual form, for example. A display device such as an organic light emitting display device includes a data driver for supplying a data signal to data lines, a scan driver for supplying a scan signal to scan lines, an emission driver for supplying an emission control signal to emission control lines, and pixels connected with the data lines, the scan lines and the emission control lines.

Reducing the size of a non-display area such as a bezel of the display device can create a bigger screen without necessarily increasing the size of the device. Accordingly, various studies have been conducted to minimize a non-display area such as a bezel of the display device.

SUMMARY

According to an exemplary embodiment of the present invention, there is provided a scan driver including: a stage configured to output scan signals, wherein the stage includes: an input circuit that controls a voltage of a first node in response to a signal supplied to a first input terminal and a signal supplied to a second input terminal a first signal processing circuit that controls a voltage of a second node in response to the signal supplied to the first input terminal and supplies a voltage of a first power to the second node in response to the signal supplied to the second input terminal; a second signal processing circuit that supplies a voltage of a second power to the first node in response to a signal supplied to a third input terminal and the voltage of the second node; a first output circuit that outputs the signal supplied to the third input terminal based on the voltage of the first node and the voltage of the second node as a first scan signal; and a second output circuit that outputs a signal supplied to a fourth input terminal based on the voltage of the first node and the voltage of the second node as a second scan signal, and wherein the second scan signal and the first scan signal are output at different times.

The signal supplied to the second input terminal may be a first clock signal, the signal supplied to the third input terminal may be a second clock signal, and the signal supplied to the fourth input terminal may be a third clock signal, and gate-on levels of the first clock signal, the second clock signal, and the third clock signal may not be overlapped with each other.

The first output circuit may include: a sixth transistor connected between the first node and a third node, wherein the sixth transistor has a gate electrode connected to the first power; a seventh transistor connected between the third input terminal and the first output terminal, wherein the seventh transistor has a gate electrode connected to the third node; an eighth transistor connected between the first output terminal and the second power, wherein the eighth transistor has a gate electrode connected to the second node; and a second capacitor connected between the third node and the first output terminal.

The second output circuit may include: a ninth transistor connected between the first node and a fourth node, wherein the ninth transistor has a gate electrode connected to the first power; a tenth transistor connected between the fourth input terminal and the second output terminal, wherein the tenth transistor has a gate electrode connected to the fourth node; an eleventh transistor connected between the second output terminal and the second power, wherein the eleventh transistor has a gate electrode connected to the second node; and a third capacitor connected between the fourth node and the second output terminal.

The input circuit may include: a first transistor connected between the first input terminal and the first node, wherein the first transistor has a gate electrode connected to the second input terminal.

The first signal processing circuit may include: a second transistor connected between the second input terminal and the second node, wherein the second transistor has a gate electrode connected to the first node; and a third transistor connected between the first power and the second node, wherein the third transistor has a gate electrode connected to the second input terminal.

The second signal processing circuit may include: a fourth transistor and a fifth transistor connected in series with each other between the first node and the second power, a gate electrode of the fourth transistor is connected to the second node, and a gate electrode of the fifth transistor is connected to the third input terminal.

The second signal processing circuit may further include: a first capacitor connected between the second node and the second power.

The first input terminal may be supplied with the second scan signal of a previous age or a start pulse.

The second scan signal may be shifted with respect to the first scan signal.

According to an exemplary embodiment of the present invention, there is provided a display device including: pixels; a scan driver including stages for supplying scan signals to the pixels through scan lines; a data driver for supplying data signals to the pixels through data lines; and a timing controller for controlling the scan driver and the data driver wherein at least one of the stages includes: an input circuit that controls a voltage of a first node in response to a signal supplied to a first input terminal and a signal supplied to a second input terminal; a first signal processing circuit that controls a voltage of a second node in response to the signal supplied to the first input terminal and supplies a voltage of a first power to the second node in response to the signal supplied to the second input terminal; a second signal processing circuit that supplies a voltage of a second power to the first node in response to a signal supplied to a third input terminal and the voltage of the second node; a first output circuit that outputs the signal supplied to the third input terminal based on the voltage of the first node and the voltage of the second node as a first scan signal; and a second output circuit that outputs a signal supplied to a fourth input terminal based on the voltage of the first node and the voltage of the second node as a second scan signal, and wherein the second scan signal is output at a different time from the first scan signal.

The second input terminal may be provided with a first clock signal, the third input terminal may be provided with a second dock signal, and the fourth input terminal may be provided with a third clock signal, and gate-on levels of the first clock signal the second clock signal, and the third clock signal may not be overlapped with each other.

The first output circuit may include: a sixth transistor connected between the first node and the third node, wherein the sixth transistor has a gate electrode connected to the first power; a seventh transistor connected between the third input terminal and the first output terminal, wherein the seventh transistor has a gate electrode connected to the third node; an eighth transistor connected between the first output terminal and the second power supply, wherein the eighth transistor has a gate electrode connected to the second node; and a second capacitor connected between the third node and the first output terminal.

The second output circuit may include: a ninth transistor connected between the first node and the fourth node, wherein the ninth transistor has a gate electrode is connected to the first power; a tenth transistor connected between the fourth input terminal and the second output terminal, wherein the tenth transistor has a gate electrode connected to the fourth node; an eleventh transistor connected between the second output terminal and the second power, wherein the eleventh transistor has a gate electrode connected to the second node; and a third capacitor connected between the fourth node and the second output terminal.

The input circuit may include: a first transistor connected between the first input terminal and the first node, wherein the first transistor has a gate electrode connected to the second input terminal, and wherein the first signal processing circuit includes: a second transistor connected between the second input terminal and the second node, wherein the second transistor has a gate electrode connected to the first node; and a third transistor connected between the first power and the second node, wherein the third transistor has a gate electrode connected to the second input terminal.

The second signal processing circuit may include: a fourth transistor and a fifth transistor connected in series with each other between the first node and the second power; and a first capacitor connected between the second node and the second power, a gate electrode of the fourth transistor is connected to the second node, and a gate electrode of the fifth transistor is connected to the third input terminal.

The first input terminal may be provided with the second scan signal of a previous stage or a start pulse.

The second scan signal may be shifted with respect to the first scan signal.

According to an exemplary embodiment of the present invention, there is provided a scan driver including: a stage that includes a first output circuit and a second output circuit, wherein the first output circuit includes: a first transistor connected between a first node and a third node, wherein the first transistor has a gate electrode connected to a first power; a second transistor connected between a first clock terminal and a first output terminal, wherein the second transistor has a gate electrode connected to the third node; and a third transistor connected between the first output terminal and a second power, wherein the third transistor has a gate electrode connected to a second node, wherein the second output circuit includes: a fourth transistor connected between the first node and a fourth node, wherein the fourth transistor has a gate electrode connected to the first power; a fifth transistor connected between a second dock terminal and a second output terminal, wherein the fifth transistor has a gate electrode connected to the fourth node; and a sixth transistor connected between the second output terminal and the second power, wherein the sixth transistor has a gate electrode connected to the second node.

The first clock terminal may be supplied with a first clock signal and the second clock terminal may be supplied with a second clock signal, wherein a low level of the first clock signal and a low level of the second clock signal may not overlap.

The first output circuit may be configured to output a first scan signal to the first output terminal at a first time and the second output circuit may be configured to output a second scan signal to the second, output terminal at a second time different from the first time.

The first scan signal and the second scan signal may be based on a voltage of the second node, the voltage of the second node may be generated in response to a third clock signal.

DETAILED DESCRIPTION OF THE EMBODIMENTS

Figure 1:
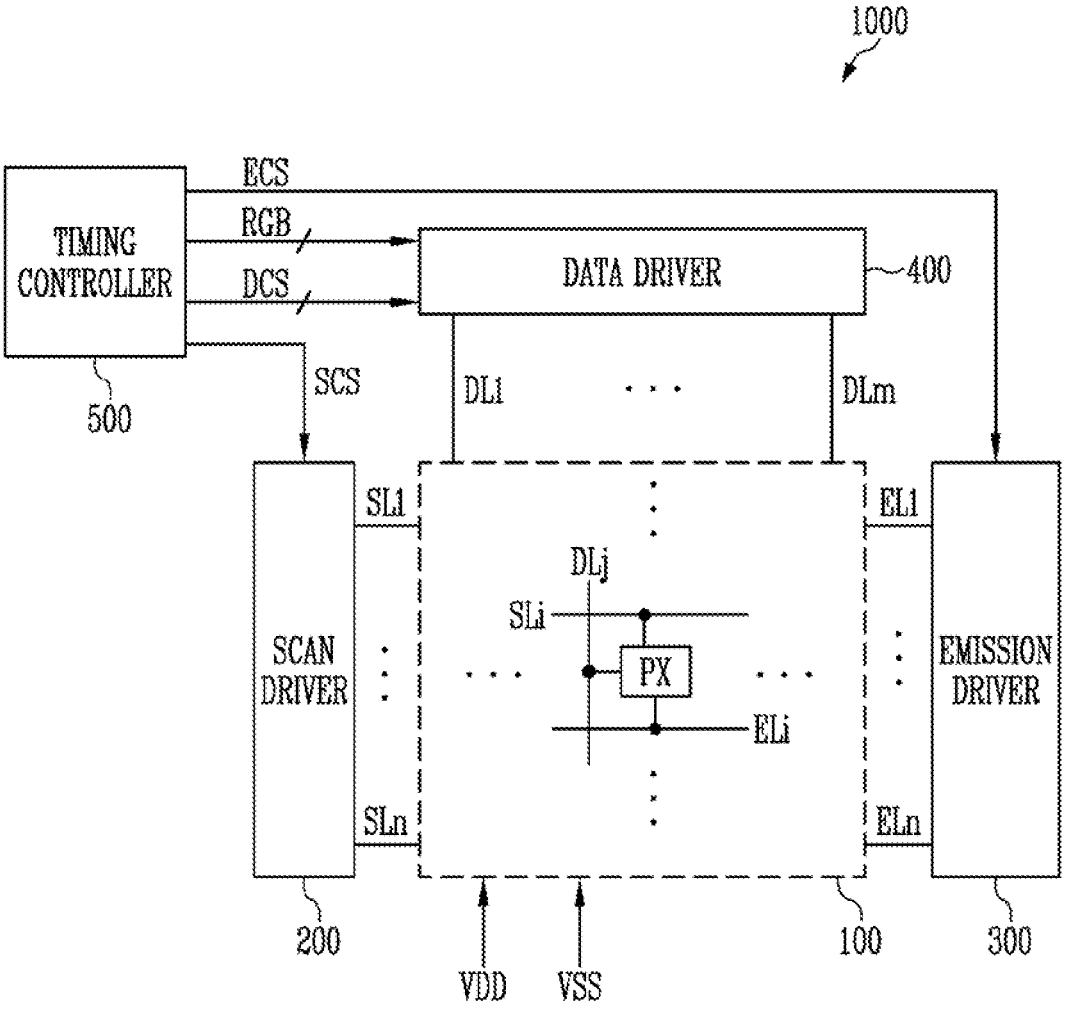
FIG. 1 is a block diagram showing a display device according to an exemplary embodiment of the present invention.

Hereinafter, exemplary embodiments of the present invention will be described in further detail with reference to the accompanying drawings. Like reference numerals may refer to like elements in the drawings, and thus, redundant explanations for like elements may be omitted.

FIG. 1 is a block diagram showing a display device according to an exemplary embodiment of the present invention.

Referring to FIG. 1, a display device 1000 may include a pixel unit 100, a scan driver 200, an emission driver 300, a data driver 400, and a timing controller 500.

The display device 1000 may display images at various driving frequencies (or image refresh rates and screen refresh rates) depending on certain driving conditions. The driving frequency is a frequency at which data signals are written to driving transistors of the pixel PX. For example, the driving frequency may be referred to as a screen refresh rate or a screen playing frequency, and represent a frequency at which a display screen is played for one second. In other words, the driving frequency may be a frequency at which an image is displayed on the display screen for one second. The display device 1000 may display an image in response to various driving frequencies of 1 Hz to 120 Hz.

The pixel unit 100 may include scan lines SL1 to SLn, emission control lines EL1 to ELn, and data lines DL1 to DLm. The pixel unit 100 may include pixels PX connected to the scan lines SL1 to SLn, the emission control lines EL1 to ELn, and the data lines DL1 to DLm (here, m and n are integers greater than 1). Each of the pixel PXs may include a driving transistor, a plurality of switching transistors, and at least one light emitting element. The pixels PX may receive voltages of a first driving power supply VDD and a second driving power supply VSS from the outside.

In an exemplary embodiment of the present invention, the light emitting element EL may be an organic light emitting diode including an organic light emitting layer. In another exemplary embodiment of the present invention, the light emitting element EL may be an inorganic light emitting element formed of an inorganic material. In another exemplary embodiment of the present invention, the light emitting element may be a light emitting element composed of an inorganic material and an organic material.

Additionally, the pixels PXs may be connected to one or more scan lines SLi is (i of n or less is a natural number) and an emission control line ELi corresponding to a circuit structure of the pixel. For example, the example pixel PX shown in FIG. 1 is connected to an i-th scan line SLi, a j-th data line DLj and an i-th emission control line ELn.

The timing controller 500 may receive an input control signal and an input image signal from an image source such as an external graphic device. The timing controller 500 generates image data RGB suitable for the operating conditions of the pixel unit 100 based on the input image signal, and provides the image data RGB to the data driver 400. The timing controller 500 may generate a first control signal SCS for controlling a driving timing of the scan driver 200 based on the input control signal, a second control signal ECS for controlling a driving timing of the emission driver 300, and a third control signal DCS for controlling a driving timing of the data driver 400. The timing controller 600 may provide the first control signal SCS, the second control signal ECS and the third control signal DCS to the scan driver 200, the emission driver 300, and the data driver 400, respectively.

The scan driver 200 may receive the first control signal SCS from the timing controller 500. The scan driver 200 may supply the scan signal to the scan lines SL1 to SLn in response to the first control signal SCS. The first control signal SCS may include a start pulse for the scan signal and a plurality of clock signals.

The scan signal may be set to a gate-on voltage (e.g. a logic low level) corresponding to a type of transistor to which the corresponding scan signal is supplied. The transistor receiving the scan signal may be set to a turn-on state when the scan signal is supplied. For example, the gate-on voltage of the scan signal supplied to a P-channel metal oxide semiconductor (PMOS) transistor may be a logic low level, and the gate-on voltage of the scan signal supplied to an N-channel metal oxide semiconductor (NMOS) transistor may be a logic high level. Hereinafter, the phrase "a scan signal is supplied" may mean that the scan signal is supplied at a logic level capable of turning on the transistor controlled by the scan signal.

In an exemplary embodiment of the present invention, the stage included in the scan driver 200 may be connected to a plurality of scan lines. The stage may supply scan signals at different times to the scan lines connected thereto. For example, the stage of the scan driver 200 may supply a first scan signal to a first scan line at a different time it supplies a second scan signal to a second scan line.

The emission driver 300 may receive the second control signal ECS from the timing controller 500. The emission driver 300 may supply an emission control signal to the emission control lines EL1 to ELn in response to the second control signal ECS. The second control signal ECS may include a start pulse for the emission control signal and a plurality of clock signals.

The emission control signal may be set to a gate-on voltage (e.g., low voltage). A transistor receiving the emission control signal may be turned on when the emission control signal is supplied, and may be turned off in other cases. Hereinafter, the phrase "an emission control signal is supplied" may mean that the emission control signal is supplied at a logic level capable of turning on the transistor controlled by the emission control signal.

In an exemplary embodiment of the present invention, the stage included in the emission driver 300 may be connected to a plurality of emission control lines. The stage may supply emission control signals at different times to emission control lines connected thereto. For example, the stage of the emission driver 300 may supply a first emission control signal to a first emission control line at a different time it supplies a second emission control signal to a second emission control line.

In FIG. 1, for convenience of description, each of the scan driver 200 and the emission driver 300 are shown as a single unit, but the present invention is not limited thereto. According to an exemplary embodiment of the present invention, the scan driver 200 may include a plurality of scan drivers that respectively supply at least one of scan signals of different waveforms. In addition, at least a portion of the scan driver 200 and the emission driver 300 may be integrated into one driving circuit, module, or the like.

The data driver 400 may receive the third control signal DCS from the timing controller 500. The data driver 400 may convert the image data RGB into an analog data signal (e.g., a data voltage) in response to the third control signal DCS, and may supply the data signal to the data lines DL1 to DLm.

In an exemplary embodiment of the present invention, the display device 1000 may further include a power supply. The power supply may supply a voltage of the first driving power VDD and a voltage of the second driving power VSS for driving the pixel PX to the pixel unit 100.

Figure 2:
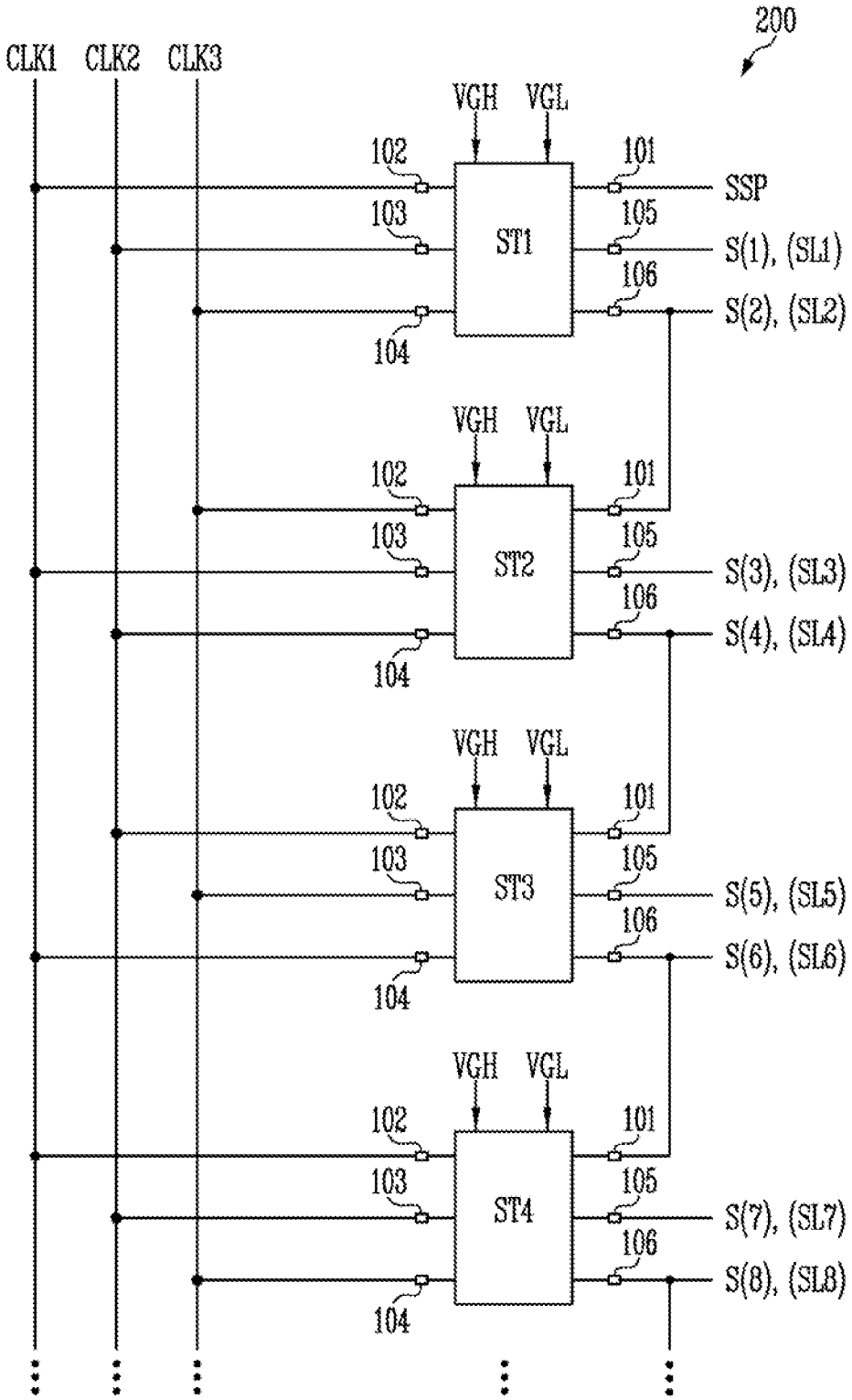
FIG. 2 is a block diagram showing a scan driver according to an exemplary embodiment of the present invention.

FIG. 2 is a block diagram showing a scan driver according to an exemplary embodiment of the present invention.

In FIG. 2, for convenience of description, four stages and scan signals output therefrom will be shown.

Referring to FIGS. 1 and 2, the scan driver 200 may include a plurality of stages ST1, ST2, ST3 and ST4. For example, the stages ST1 to ST4 may be connected to scan lines SL1 SL2, SL3, SL4, SLS, SL6, SL7 and SL8, respectively, and may output a scan signal in response to clock signals CLK1, CLK2, and CLK3. The stages ST1 to ST4 may be implemented with substantially the same circuit as each other.

Although the stages ST1 to ST4 of the scan driver 200 are shown in FIG. 2, this is merely exemplary. For example, the emission driver 300 may also have substantially the same or similar configuration to the stages ST1 to ST4 of FIG. 2. In this case, the stages ST1 to ST4 may output the emission control signals.

In one exemplary embodiment of the present invention, each of the first to fourth stages ST1 to ST4 may be connected to two scan lines. For example, the first stage ST1 may be connected to the first scan line SL1 and the second scan line SL2. The first stage ST1 may supply a first scan signal S(1) to the first scan line SL1 and a second scan signal S(2) to the second scan line SL2. The first scan line SL1 may be connected to a first pixel raw (e.g., a first horizontal line) of the pixel unit 100, and the second scan line SL2 may be connected to a second pixel row (e.g., a second horizontal line) of the pixel unit 100. The first scan signal S(1) and the second scan signal S(2) may have substantially the same pulse and may be output at different times. For example, the second scan signal S(2) may be a signal to which the first scan signal S(1) is shifted by a predetermined period. In other words, the second scan signal S(2) may be shifted with respect to the first scan signal S(1).

Similarly, the second stage ST2 may be connected to the third scan line SL3 and the fourth scan line SL4. The second stage ST2 may supply a third scan signal S(3) to the third scan line SL3, and may supply a fourth scan signal S(4) to the fourth scan line SL4. The third stage ST3 may supply a fifth scan signal S(5) to a fifth scan line SLS, and may supply a sixth scan signal S(6) to a sixth scan line SL6. The fourth stage ST4 may sup ply a seventh scan signal S(7) to a seventh scan line SL7, and may supply an eighth scan signal S(8) to an eighth scan line SL8.

The first to eighth scan signals S(1) to S(8) are arbitrarily defined for convenience of description, and the first to eighth scan signals S(1) to S(8) may have substantially the same pulse and may be output at different times.

In addition, a connection relationship between the scan lines SL1 to SL8 and the horizontal lines (e.g., pixel rows) may be variously set according to a pixel structure and a driving method of the display device 1000. For example, the first scan line SL1 connected to the first stage ST1 may be commonly connected to a plurality of horizontal lines (or pixel rows).

Each of the stages ST1 to ST4 may include a first input terminal 101, a second input terminal 102, a third input terminal 103, a fourth input terminal 104, a first output terminal 105, and a second output terminal 106.

The first input terminal 101 may receive an output signal (e.g., second scan signal S(2)) output from the second output terminal 106 of the previous stage or a start pulse SSP. For example, the first input terminal 101 of the first stage ST1 receives the start pulse SSP, and the first input terminal 101 of the second stage ST2 may receive the second scan signal S(2) output from the first stage ST1.

In an exemplary embodiment of the present invention, the second input terminal 102 of the k-th stage (here, k is a natural number) may receive the first clock signal CLK1, the third input terminal 103 of the k-th stage may receive the second clock signal CLK2, and the fourth input terminal 104 of the k-th stage may receive the third clock signal CLK3. On the other hand, the second input terminal 102 of the k+1-th stage receives the third clock signal CLK3, the third input terminal 103 of the k+1-th stage may receive the first clock signal CLK1, and the fourth input terminal 104 of the k+1-th stage may receive the second clock signal CLK2. The second input terminal 102 of the k+2-th stage may receive the second clock signal CLK2, the third input terminal 103 of the k+2-th stage may receive the third clock signal CLK3, and the fourth input terminal 104 of the k+2-th stage may receive the first dock signal CLK1.

The first clock signal CLK1, the second clock signal CLK2, and the third clock signal CLK3 have the same period and phases of the first clock signal CLK1, the second clock signal CLK2, and the third clock signal CLK3 do not overlap each other. In other words, gate-on levels (e.g., a logic low level) of the first clock signal CLK1, the second clock signal CLK2, and the third clock, signal CLK3 do not overlap each other. For example, each of the second clock signal CLK2 and the third clock signal CLK3 may be set to signals shifted by a different time from the first clock signal CLK1.

Additionally, the stages ST1 to ST4 receive a voltage of the first power supply VGL and a voltage of the second power supply VGH. The voltage of the first power supply VGL and the voltage of the second power supply VGH may have a direct current (DC) voltage level. The voltage of the second power supply VGH may be set larger than the voltage of the first power supply VGL.

The voltage of the first power supply VGL may be set to a gate-on level, and the voltage of the second power supply VGH may be set to a gate-off level. For example, when the pixel PX is composed of PMOS transistors, the voltage (e.g., gate-on level) of the first power supply VGL may correspond to a low level, and the voltage (e.g. gate-off level) of the second power supply VGH may correspond to a high level. However, this is merely exemplary, and the first power supply VGL and the second power supply VGH are not limited thereto. For example, the voltage of the first power supply VGL and the voltage of the second power supply VGH may be set depending on a type of transistor, use environment of the display device 1000, and the like.

Figure 3:
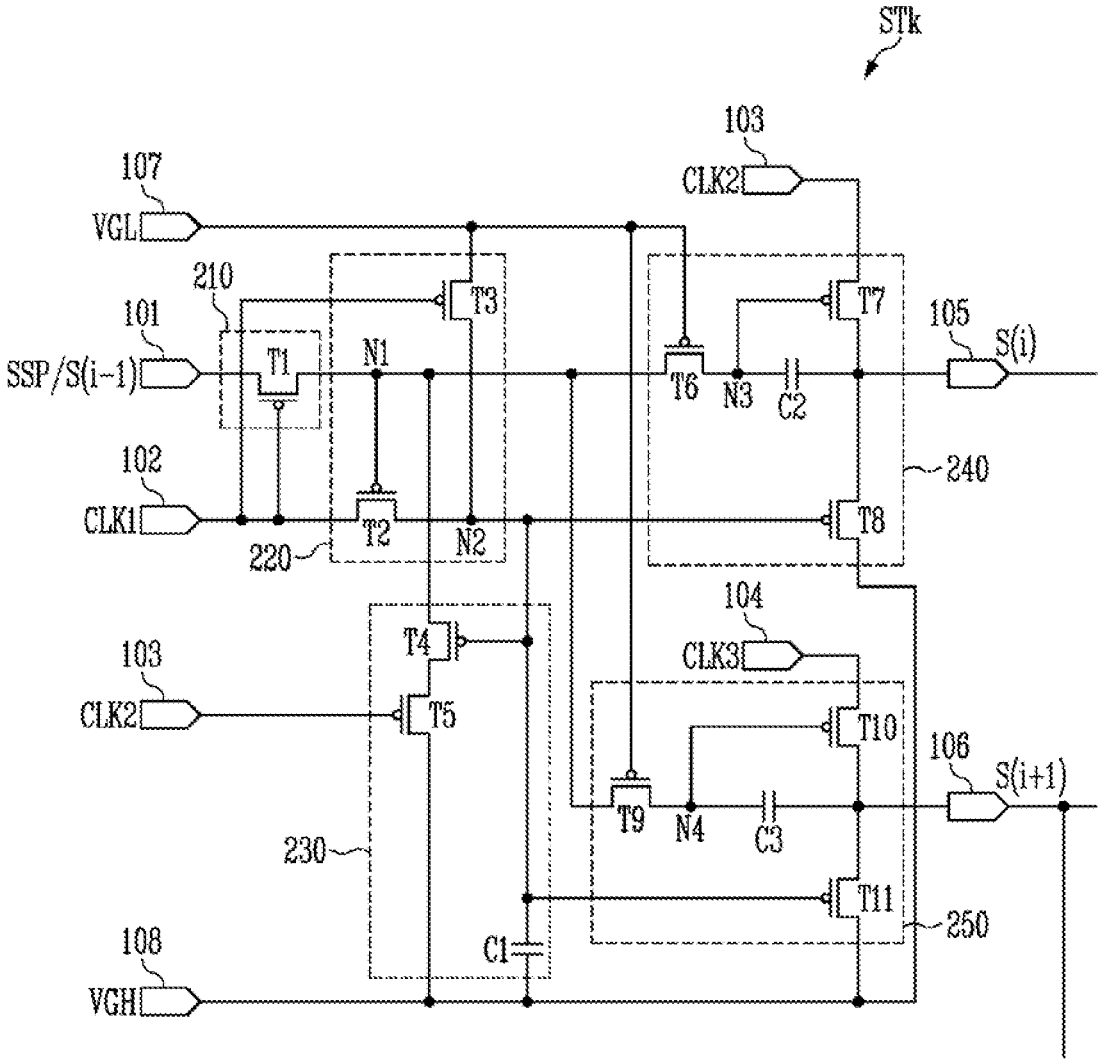
FIG. 3 is a circuit diagram showing, a stage included in the scan driver of FIG. 2, according to an exemplary embodiment of the present invention.

FIG. 3 is a circuit diagram showing a stage included in the scan driver of FIG. 2, according to an exemplary embodiment of the present invention.

Referring to FIGS. 2 and 3, the k-th stage STk (here, k is a natural number) may include an input circuit 210, a first signal processing circuit 220, a second signal processing circuit 230, and a first output circuit 240, and a second output circuit 250.

As shown in FIG. 3, the k-th stage STk in which the first clock signal CLK1 is supplied to the second input terminal 102, the second clock signal CLK2 is supplied to the third input terminal 103, and the third clock signal CLK3 is supplied to the fourth input terminal 104, will be mainly described. However, this is merely exemplary, and the third clock signal CLK3 may be supplied to the second input terminal 102, the first clock signal CLK1 may be supplied to the third input terminal 103, and the second clock signal CLK2 may be supplied to the fourth input terminal 104 in the k+1-th stage. In the k+2-th stage, the second clock signal CLK2 may be supplied to the second input terminal 102, the third clock signal CLK3 may be supplied to the third input terminal 103, and the first clock signal CLK1 may be supplied to the fourth input terminal 104.

In an exemplary embodiment of the present invention, the start pulse SSP may be supplied to the first input terminal 101 of the first stage ST1, and a scan signal output from the second output terminal 106 of the previous stage may be supplied to the first input terminal 101 of the other stages.

Hereinafter, the k-th stage STk mill be referred to as a stage STk.

The input circuit 210 may control a voltage of the first node N1 in response to signals supplied to the first input terminal 101 and the second input terminal 102. In an exemplary embodiment of the present invention, the input circuit 210 may include first transistor T1.

The first transistor T1 may be connected between the first input terminal 101 and the first node N1. The first transistor T1 may include a gate electrode connected to the second input terminal 102. The first transistor T1 may be turned on when the first clock signal CLK1 has a gate-on level (e.g., a low level) to electrically connect the first input terminal 101 and the first node N1.

The first signal processing circuit 220 may control a voltage of the second node N2 in response to the signal supplied to the first input terminal 101, and may supply a voltage of the first power supply VGL to the second node N2 in response to the signal supplied to the second input terminal 102. In an exemplary embodiment of the present invention, the first signal processing circuit 220 may include a second transistor T2 and a third transistor T3.

The second transistor 12 may be connected between the second input terminal 102 and the second node N2. A gate electrode of the second transistor T2 may be connected to the first node N1. The second transistor T2 may be turned on or off in response to the voltage of the first node N1.

In an exemplary embodiment of the present invention, the second transistor T2 may include a plurality of sub-transistors connected in series with each other. Each of the sub-transistors may include a gate electrode commonly connected to the first node N1 (e.g., a dual gate structure). Accordingly, a leakage of current caused by the second transistor T2 may be minimized. However, this is merely exemplary, and at least one of the other transistors as well as the second transistor T2 may have the dual gate structure.

The third transistor T3 may be connected between the first power terminal 107 to which a voltage of the first power supply VGL is input and the second node N2.

A gate electrode of the third transistor T3 may be connected to the second input terminal 102. The third transistor T3 may be turned on when the first clock signal CLK1 is supplied to the second input terminal 102 to supply the voltage of the first power supply VGL to the second node N2.

The second signal processing circuit 230 may supply the voltage of the second power supply VGH to the first node N1 in response to a signal supplied to the third input terminal 103 and the voltage of the second node N2. In an exemplary embodiment of the present invention, the second signal processing circuit 230 may include a fourth transistor T4, a fifth transistor T5, and a first capacitor C1.

The fourth transistor T4 and the fifth transistor T5 may be connected in series between the first node N1 and the second power terminal 108 to which the voltage of the second power supply VGH is supplied. A gate electrode of the fourth transistor T4 may be connected to the second node N2. A gate electrode of the fifth transistor T5 may be connected to the third input terminal 103.

The fourth transistor T4 may be turned on or off in response to the voltage of the second node N2.

The fifth transistor T5 may be turned on in response to the gate-on level of the second clock signal CLK2 supplied to the third input terminal 103.

The first capacitor C1 may be connected between the second node N2 and the second power terminal 108. A voltage difference between the voltage of the second node N2 and the voltage of the second power supply VGH may be charged in the first capacitor C1. The first capacitor C1 may serve to stably maintain (or hold) the low level of the second node N2 by the voltage of the second power supply VGH that is a DC voltage.

The first output circuit 240 may output a signal supplied to the third input terminal 103 based on the voltage of the first node N1 and the voltage of the second node N2 to the first output terminal 105 as the i-th scan signal Si (i an integer of k or more). In an exemplary embodiment of the present invention, the first output circuit 240 may include a sixth transistor T6, a seventh transistor T7, an eighth transistor T8, and a second capacitor C2.

The sixth transistor T6 may be connected between the first node N1 and the third node N3. A gate electrode of the sixth transistor T6 may be connected to the first power terminal 107 to which the voltage of the first power supply VGL is supplied. Therefore, the sixth transistor T6 may have a turn-on state. When the voltage of the third node N3 falls to a value lower than the voltage of the first power supply VGL by coupling (or boosting) of the second capacitor C2, the voltage of the first node N1 may be maintained relatively stable by the sixth transistor T6. For example, the voltage of the first node N1 is not lower than the voltage of the first power supply VGL. Accordingly, even if a change of the voltage of the third node N is large, a magnitude of a drain-source voltage of the first transistor T1 may not suddenly increase, and bias stress that may be applied to the first transistor T1 may be mitigated. Accordingly, the first transistor T1 may be protected from a fluctuation of the voltage of the third node N3.

The seventh transistor T7 may be connected between the third input terminal 103 and the first output terminal 105. A gate electrode of the seventh transistor T7 may be connected to the third node N3. For example, the gate of the seventh transistor T7 may be connected between the sixth transistor T6 and the second capacitor C2. The seventh transistor T7 may be turned on or off in response to the voltage of the third node N3. Here, the i-th scan signal S(i) supplied to the first output terminal 105 while the seventh transistor T7 is turned on may be at a love level (e.g., a gate-on voltage of the P-type transistor).

The eighth transistor T8 may be connected between the first output terminal 105 and the second power supply VGH (e.g., the second power terminal 108). A gate electrode of the eighth transistor T8 may be connected to the second node N2. The eighth transistor T8 may be turned on or off based on the voltage of the second node N2. When the eighth transistor T8 is turned on, the i-th scan signal S(i) supplied to the first output terminal 105 may have a high level (e.g., a gate-off voltage of the P-type transistor).

The second capacitor C2 may be connected between the third node N3 and the first output terminal 105. The second capacitor C2 may couple the voltage of the first output terminal 105 and the voltage of the third node N3. For example, the second capacitor C2 may boost the voltage of the third node N3 based on the voltage of the first output terminal 105.

The second output circuit 250 may output a signal supplied to the fourth input terminal 104 based on the voltage of the first node N1 and the voltage of the second node N2 to the second output terminal 106 as the i+1-th scan signal S(i+1). In an exemplary embodiment of the present invention, the second output circuit 250 may include a ninth transistor T9, a tenth transistor T10, an eleventh transistor T11, and a third capacitor C3.

The configuration and operation of the second output circuit 250 may be similar to the first output circuit 240.

The ninth transistor T9 may be connected between the first node N1 and the fourth node N4. For example, the ninth transistor T9 may be connected to the sixth transistor T6 (the first node N1) and the third capacitor C3. A gate electrode of the ninth transistor T9 may be connected to the first power supply VGL (e.g., first power terminal 107). Therefore, the ninth transistor T9 may have a turn-on state. When the voltage of the fourth node N4 falls to a value lower than the voltage of the first power supply VGL by coupling (e.g., boosting) of the third capacitor C3, the voltage of the first node N1 may be maintained relatively stable by the ninth transistor T9. Accordingly, the first transistor T1 may be protected from a fluctuation of the voltage of the fourth node T4.

The tenth transistor T10 may be connected between the fourth input terminal 104 and the second output terminal 106. A gate electrode of the tenth transistor T10 may be connected to the fourth node N4. The tenth transistor T10 may be turned on or off in response to the voltage of the fourth node N4. Here, the i+1-th scan signal S(i+1) supplied to the second output terminal 106 while the tenth transistor T10 is turned on may be at a low level (e.g., a gate-on voltage of the P-type transistor).

The eleventh transistor T11 may be connected between the second output terminal 106 and the second power supply VGH (e.g., second power terminal 108). A gate electrode of the eleventh transistor T11 may be connected to the second node N2. The gate electrode of the eleventh transistor T11 may also be connected to the first capacitor C1. The eleventh transistor T11 may be turned on or off based on the voltage of the second node N2.

The third capacitor C3 may be connected between the fourth node N4 and the second output terminal 106. The third capacitor C3 may couple the voltage of the second output terminal 106 and the voltage of the fourth node N4.

As described above, the first output circuit 240 and the second output circuit 250 may share the first node N1 and the second node N2, and may respectively output the i-th scan signal S(i) and the i+1-th scan signal S(i+1) by using the difference in time which the clock signals CLK2 and CLK3 supplied to the third input terminal 103 and the fourth input terminal 104 have the gate-on level. Therefore, the stage STk may stably output the i-th and i+1-th scan signals S(i) and S(i+1) at different times with the same waveform using only three clock signals CLK1, CLK2, and CLK3 and, although the first output circuit 240 and the second output circuit 250 share similar configurations, the first output circuit 240 receives the second clock signal CLK2 via the second input terminal 103 and the second output circuit 250 receives the third clock signal CLK3 via the fourth input terminal 104.

Accordingly, an area occupied by the scan driver 200 in the display device 1000 may be reduced. In addition, a plurality of different scan signals can be output from one stage STk with a minimum number of clock signals CLK1, CLK2, and CLK3 and a line structure, so that manufacturing cost and power consumption of the display device 1000 can be reduced.

Figure 4:
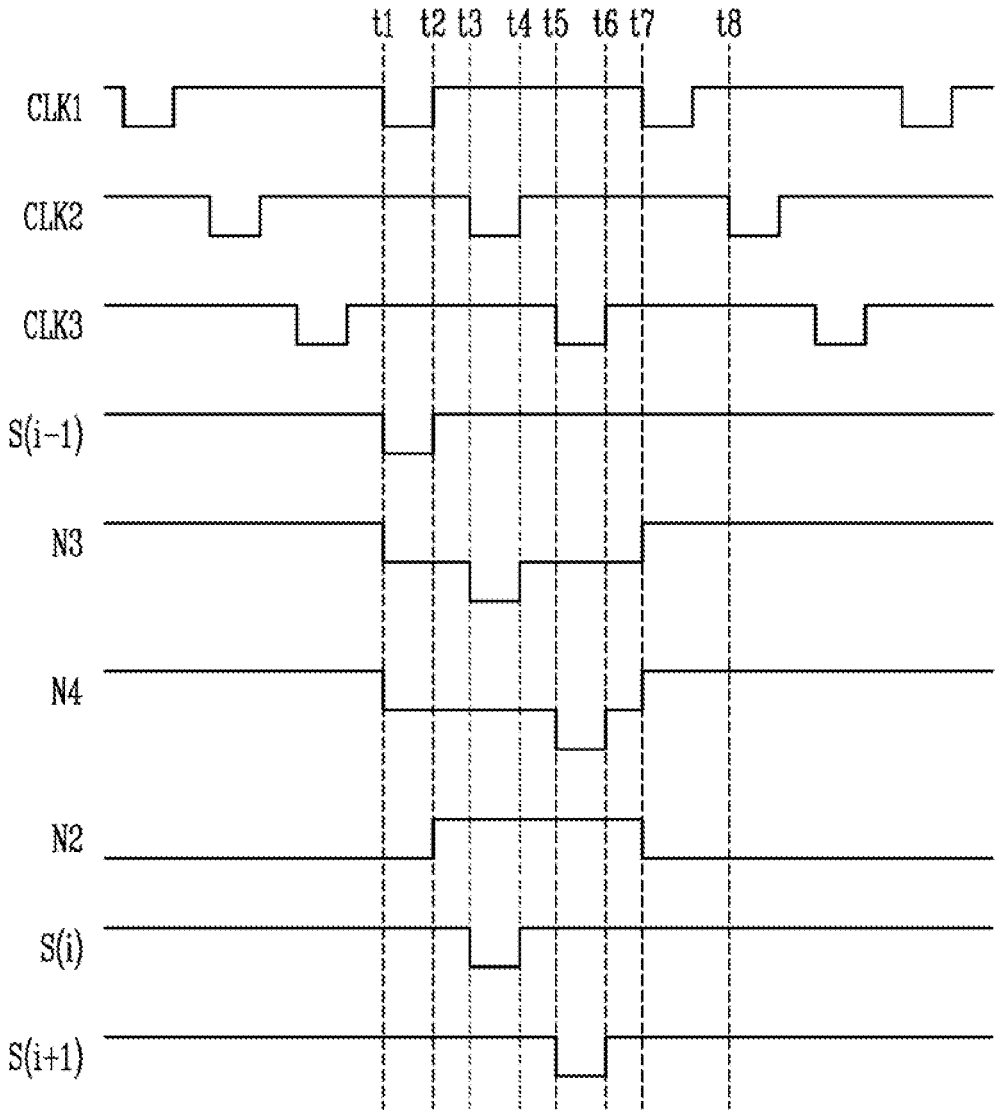
FIG. 4 is a timing diagram showing an operation of a stage of FIG. 3, according to an exemplary embodiment of the present invention.

FIG. 4 is a timing diagram showing an operation of a stage of FIG. 3, according to an exemplary embodiment of the present invention.

Referring to FIGS. 1, 3, and 4, the first clock signal CLK1, the second clock signal CLK2, and the third clock signal CLK3 may be supplied at different times. The gate-on levels (e.g., logic low levels) of the first clock signal CLK1, the second clock signal CLK2, and the third clock signal CLK3 do not overlap each other.

For example, the second clock signal CLK2 may be set to a signal shifted by one horizontal period from the first clock signal CLK1, and the third clock signal CLK3 may be set to a signal shifted by one horizontal period from the second clock signal CLK2. The first, second and third clock signals CLK1 to CLK3 may be activated in sequence.

The high level (or high voltage) of the start pulse SSP may correspond to the voltage of the second power supply VGH, and the low level (or low voltage) of the start pulse SSP may correspond to the voltage of the first power supply VGL. For example, the voltage of the first power supply VGL may be about −8V, and the voltage of the second power supply VGH may be about 10V. However, this is merely exemplary, and a level of the voltage of the start pulse is not limited thereto.

In addition, the low level of the third node N3 may be similar to a value obtained by adding an absolute value of the threshold voltage of the sixth transistor T6 to the voltage of the first power supply VGL. However, since the threshold voltage of the sixth transistor T6 is very small compared to the voltage of the first power supply VGL, a low level of the third node N3, a low level of the fourth node N4, and the voltage of the first power supply VGL, a low level of the start pulse SSP, and a low level of the scan signal may be substantially the same as or similar to each other and will be hereinafter described.

In addition a 2-low level (e.g., a voltage of the third node N3 from the third time point t3 to the fourth time point t4) may be a voltage level similar to 2*VGL−VGH.

Hereinafter, it will be described that, when the first to third clock signals CLK1, CLK2, and CLK3 are supplied, the voltage of the first power supply VGL (or a voltage of a low level, gate-on voltage) is supplied to each of the second input terminal 102, the third input terminal 103, and the fourth input terminal 104. In addition, when the first to third clock signals CLK1, CLK2, CLK3 are not supplied, the voltage of the second power supply VGH (or a voltage of a high level, gate-off voltage) is supplied to each of the second input terminal 102, the third input terminal 103, and the four input terminal 104.

The i−1-th scan signal S(i−1) has a high level after the second time point t2.

The i−1-th scan signal S(i−1) may be supplied to the first input terminal 101 at the first time point t1, and the first clock signal CLK1 may be supplied to the second input terminal 102. In other words, between the first time point t1 and the second time point t2, the i−1-th scan signal and the first clock signal CLK1 may be a low level.

The first transistor T1 may be turned on by the first clock signal CLK1, and the voltage of the first node N1 may be at a low level. The voltage of the third node N3 and the voltage of the fourth node N4 may be changed to a low level by the sixth transistor T6 and the ninth transistor T9 in the turn-on state.

In addition, the second transistor T2 may be turned on in response to the voltage of the first node N1 at the low level, and the third transistor T3 may be turned on in response to the first clock signal CLK1 at the low level. Therefore, the second node N2 may have a voltage of a low level.

The supply of the i−1-th scan signal S(i−1) and the first clock signal CLK1 may be stopped at the second time point t2. In other words, both of the i−1-th scan signal S(i−1) and the first clock signal CLK1 may transition to a high level at the second time point t2. Since the voltage of the first node N1 is maintained as the low level, the second transistor T2 may be in the turn-on state at the second time point t2. Therefore, the high level of the first clock signal CLK1 may be supplied to the second node N2, and the voltage of the second node N2 may transition to a high level at the second time point t2.

The second clock signal CLK2 may be supplied to the third input terminal 103 at the third time point t3. Since the voltage of the first output terminal 105 transitions to a low level by the second clock signal CLK2, the voltage of the third node N3 may transition to the 2-low level by coupling of the second capacitor C2. In other words, the voltage of the third node N3 may drop even lower between the third time point t3 and the fourth time point t4. Accordingly, the seventh transistor T7 may be completely turned on so that the i-th scan signal S(i) of a low-level may be output to the first output terminal 105.

The supply of the second clock signal CLK2 may be stopped at the fourth time point t4 and the voltage of the first output terminal 105 may be changed to a high level. Accordingly, the voltage of the third node N3 may transition to a low level. The output of the i-th scan signal S(i) may be stopped at the fourth time point t4. In other words, a high level of the i-th scan signal S(i) is output at the fourth time point t4.

The third clock signal CLK3 may be supplied to the fourth input terminal 104 at a fifth time point t5. Since the voltage of the second output terminal 106 transitions to the low level by the third clock signal CLK3, the voltage of the fourth node N4 may transition to the 2-low level by coupling of the third capacitor C3. In other words, the voltage of the fourth node N4 may drop even lower between the fourth time point t4 and the fifth time point t5. Accordingly, the tenth transistor T10 may be completely turned on so that the i+1-th scan signal S(i+1) of a low level may be output to the second output terminal 106.

The supply of the third clock signal CLK3 may be stopped at the sixth time point t6, and the voltage of the second output terminal 106 may be changed to a high level. Accordingly, the voltage of the fourth node N4 may transition to a low level. The output of the i+1-th scan signal S(i+1) may be stopped at the sixth time point t6. In other words, a high level of the i+1-th scan signal S(i+1) is output at the sixth time point t6.

As described above, the i-th scan signal S(i) may be output in synchronization with the second clock signal CLK2, and the i+1-th scan signal S(i+1) may be output in synchronization with the third clock signal CLK3. For example, the low level of the i-th scan signal S(i) and the second clock signal CLK2 may overlap, and the low level of the i+1-th scan signal S(i+1) and the third clock signal CLK3 may overlap.

The first clock signal CLK1 may be supplied again to the second input terminal 102 at a seventh time point t7. The first transistor T1 may be turned on in response to the first clock signal CLK1, and the voltage of the first node N1 may transition to a high level. Accordingly, the voltage of the third node N3 and the voltage of the fourth node N4 may also transition to the high level by the turned-on sixth transistor T6 and ninth transistor T9.

In addition, the third transistor T3 may be turned on in response to the first clock signal CLK1 at the seventh time point t7, and the voltage of the first power supply VGL may be supplied to the second node N2. Therefore, the voltage of the second node N2 may transition to a low level.

The fourth transistor T4 may be turned on in response to the voltage of the second node N2 at the low level, Since the voltage of the second power supply VGH, which is a DC voltage, is supplied to one terminal of the first capacitor C1, the voltage of the second node N2 can stably maintain a low level after the seventh time point t7.

Thereafter, the second clock signal CLK2 may be supplied to the third input terminal 103 at an eighth time point t8. The fifth transistor T5 may be turned on in response to the second clock signal CLK2, and the voltage of the second power supply VGH may be supplied to the first node N1 through the fifth transistor T5 and the fourth transistor T4. In other words, after the seventh time point t7, the voltage of the second power supply VGH is periodically supplied to the first node N1 by the second clock is signal CLK2, so that voltages of the third node N3 and the fourth node N4 can stably maintain a high level.

As described above, the stage STk may stably output the i-th and i+1-th scan signals S(i) and S(i+1) at different times with the same waveform using a simple structure sharing all configurations except for the first output circuit 240 and the second output circuit 250 and only three clock signals CLK1, CLK2, and CLK3.

Accordingly, an area occupied by the scan driver 200 in the display device 1000, manufacturing cost, and power consumption of the display device 1000 may be reduced.

According to an exemplary embodiment of the present invention shown in FIGS. 1-4, the scan driver 200 includes a stage STk configured to output scan signals, wherein the stage STk includes: an input circuit 210 that controls a voltage of a first node N1 in response to a signal supplied to a first input terminal 101 and a signal supplied to a second input terminal 102; a first signal processing circuit 220 that controls a voltage of a second node N2 in response to the signal supplied to the first input terminal 101 and supplies a voltage of a first power VGL to the second node N2 in response to the signal supplied to the second input terminal 102; a second signal processing circuit 230 that supplies a voltage of a second power VGH to the first node N1 in response to a signal supplied to a third input terminal 103 and the voltage of the second node N2; a first output circuit 240 that outputs the signal supplied to the third input terminal 103 based an the voltage of the first node N1 and the voltage of the second node N2 as a first scan signal S(i), and a second output circuit 250 that outputs a signal supplied to a fourth input terminal 104 based on the voltage of the first node N1 and the voltage of the second node N2 as a second scan signal S(i+1). The second scan signal S(i+1) and the first scan signal S(i) are output at different times.

Figure 5:
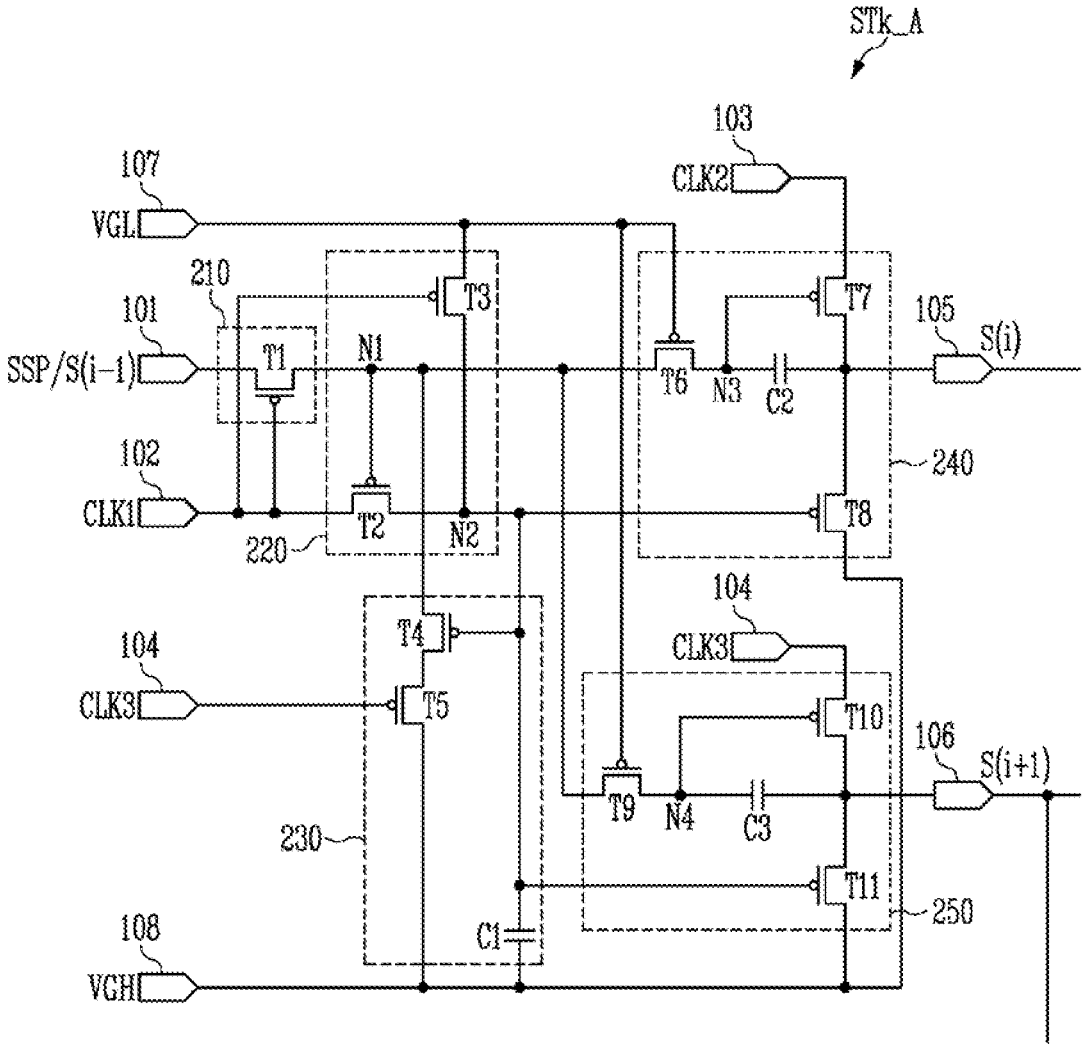
FIG. 5 is a circuit diagram for showing a stage included in the scan driver of FIG. 2, according to an exemplary embodiment of the present invention.

FIG. 5 is a circuit diagram for showing a stage included in the scan driver of FIG. 2, according to an exemplary embodiment of the present invention.

In FIG. 5, the same reference numerals may be used for constituent elements described with reference to FIG. 3, and thus a duplicate description of these constituent elements may be omitted. In addition, the stage STk_A of FIG. 5 may have a configuration substantially the same as or similar to the stage STk of FIG. 3 except for the configuration of an input terminal connected to the gate electrode of the fifth transistor T5.

Referring to FIGS. 4 and 5, the stage STk_A may include an input circuit 210, a first signal processing circuit 220, a second signal processing circuit 230, a first output circuit 240, and a second output circuit 250.

In an exemplary embodiment of the present invention, a gate electrode of the fifth transistor T5 may be connected to the fourth input terminal 104. The fifth transistor T5 may be turned on in response to the third clock signal CLK3.

Since the second signal processing circuit 230 periodically supplies the voltage of the second power supply VGH to the first node N1 during a period after the seventh time point t7, the gate electrode of the fifth transistor T5 may be connected to either the third input terminal 103 or the fourth input terminal 104. Accordingly, after the seventh time point t7, the voltage of the second power supply VGH is periodically supplied to the first node N1 by the third clock signal CLK3, so that voltages of the third node N3 and the fourth node N4 can stably maintain a high level.

Figure 6:
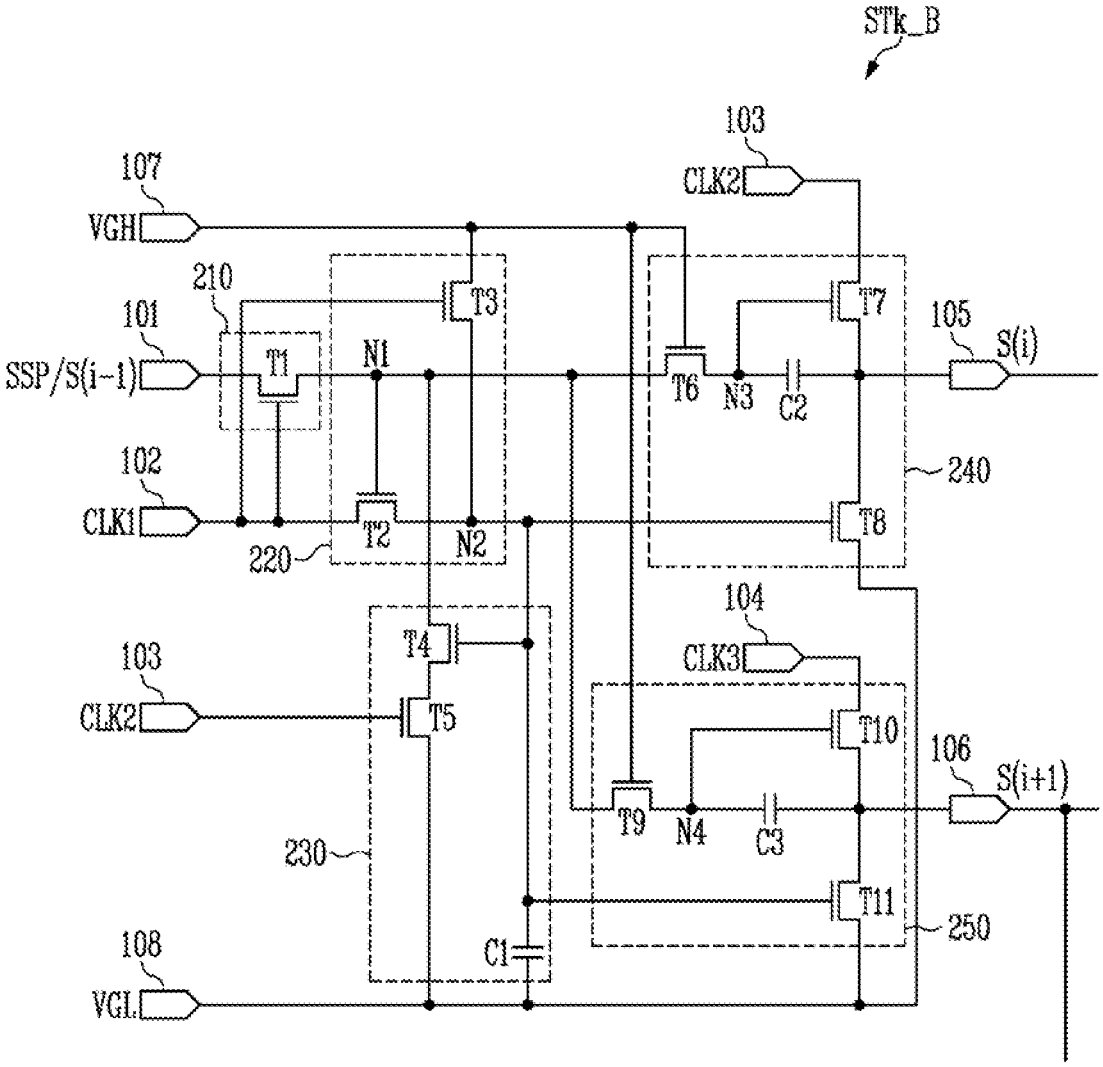
FIG. 6 is a circuit diagram showing a stage included in the scan driver of FIG. 2, according to an exemplary embodiment of the present invention.

FIG. 6 is a circuit diagram showing a stage included in the scan driver of FIG. 2, according to an exemplary embodiment of the present invention.

In FIG. 6, the same reference numerals may be used for constituent elements described with reference to FIG. 3, and thus a duplicate description of these constituent elements may be omitted. In addition, the stage STk_B of FIG. 6 may have a configuration substantially the same as or similar to the stage STk of FIG. 3 except for the type of transistors and voltage levels of input signals and output signals.

Referring to FIG. 6, the stage STk_B may include an input circuit 210, a first signal processing circuit 220, a second signal processing circuit 230, a first output circuit 240, and a second output circuit 250.

The first to eleventh transistors T1 to T11 may be n-type transistors. Accordingly, the first to third clock signals CLK1, CLK2, and CLK3 may have a waveform opposite to the waveform of FIG. 4. In addition, the voltage of the second power supply VGH may be supplied to the first power terminal 107, and the voltage of the first power supply VGL may be supplied to the second power terminal 108.

Accordingly, the i-th scan signal S(i) and the i+1-th scan signal S(i+1) may be output in a waveform opposite to the waveform of FIG. 4. The stage STk_B of FIG. 6 may be applied to a pixel, a scan driver, and a display device driven by an n-type transistor.

As described above, a scan driver and a display device according to exemplary embodiments of the present invention may include a stage that shares a configuration except for a first output circuit and a second output circuit, and has a simple structure for realizing multi-output of a scan signal. In addition, one stage can stably output scan signals of the same waveform at different times using three clock signals.

Accordingly, an area occupied by the scan driver in the display device, a manufacturing cost, and power consumption of the display device can be reduced.

While the present invention has been shown and described with reference to exemplary embodiments thereof, it will be understood by those skilled in the art that various changes in form and detail may be made thereto without departing from the spirit and scope of the present invention as set forth in the appended claims.

What is claimed is:

1. A scan driver, comprising:

a stage configured to output scan signals, wherein the stage comprises:

an input circuit that controls a voltage of a first node in response to a signal supplied to a first input terminal and a signal supplied to a second input terminal, wherein the input circuit includes a first transistor connected between the first input terminal and the first node;

a first signal processing circuit that controls a voltage of a second node in response to the signal supplied to the first input terminal and supplies a voltage of a first power to the second node in response to the signal supplied to the second input terminal, wherein the first signal processing circuit includes a second transistor connected between the second input terminal and the second node and a third transistor connected between the first power and the second node;

a second signal processing circuit that supplies a voltage of a second power to the first node in response to a signal supplied to a third input terminal and the voltage of the second node, wherein the second signal processing circuit includes a fourth transistor and a fifth transistor connected in series with each other between the first node and the second power;

a first output circuit that outputs the signal supplied to the third input terminal based on the voltage of the first node and the voltage of the second node as a first scan signal from a first output terminal between two transistors of the first output circuit in series with each other; and a second output circuit that outputs a signal supplied to a fourth input terminal based on the voltage of the first node and the voltage of the second node as a second scan signal from a second output terminal between two transistors of the second output circuit in series with each other, wherein the second scan signal and the first scan signal are output at different times.

2. The scan driver of claim 1, wherein the signal supplied to the second input terminal is a first clock signal, the signal supplied to the third input terminal is a second clock signal, and the signal supplied to the fourth input terminal is a third clock signal, and gate-on levels of the first clock signal, the second clock signal, and the third, clock signal are not overlapped with each other.

3. The scan driver of claim 2, wherein the first transistor of the input circuit has a gate electrode connected to the second input terminal.

4. The scan driver of claim 3, wherein the second transistor of the first signal processing circuit has a gate electrode connected to the first node; and the third transistor of the first signal processing circuit has a gate electrode connected to the second input terminal.

5. The scan driver of claim 4, wherein a gate electrode of the fourth transistor of the second signal processing circuit is connected to the second node, and a gate electrode of the fifth transistor of the second signal processing circuit is connected to the third input terminal.

6. The scan driver of claim 5, wherein the second signal processing circuit further comprises:

a first capacitor connected between the second node and the second power.

7. The scan driver of claim 6, wherein the first output circuit comprises:

a sixth transistor connected between the first node and a third node, wherein the sixth transistor has a gate electrode connected to the first power;

a seventh transistor connected between the third input terminal and the first output terminal, wherein the seventh transistor has a gate electrode connected to the third node;

an eighth transistor connected between the first output terminal and the second power, wherein the eighth transistor has a gate electrode connected to the second node; and a second capacitor connected between the third node and the first output terminal wherein the seventh and eighth transistors are the two transistors of the first output circuit connected in series with each other.

8. The scan driver of claim 7, wherein the second output circuit comprises:

a ninth transistor connected between the first node and a fourth node, wherein the ninth transistor has a gate electrode connected to the first power;

a tenth transistor connected between the fourth input terminal and the second output terminal, wherein the tenth transistor has a gate electrode connected to the fourth node:

an eleventh transistor connected between the second output terminal and the second power, wherein the eleventh transistor has a gate electrode connected to the second node; and a third capacitor connected between the fourth node and the second output terminal, wherein the tenth and eleventh transistors are the two transistors of the second output circuit connected in series with each other.

9. The scan driver of claim 2, wherein the first input terminal is supplied with the second scan signal of a previous stage.

10. The scan driver of claim 2, wherein the second scan signal is shifted with resect to the first scan signal.

11. A display device, comprising:

pixels;

a scan driver including stages for supplying scan signals to the pixels through scan lines;

a data driver for supplying data signals to the pixels through data lines; and a timing controller for controlling the scan driver and the data driver, wherein at least one of the stages comprises:

an input circuit that controls a voltage of a first node in response to a signal supplied to a first input terminal and a signal supplied to a second input terminal, wherein the input circuit includes a first transistor connected between the first input terminal and the first node;

a first signal processing circuit that controls a voltage of a second node in response to the signal supplied to the first input terminal and supplies a voltage of a first power to the second node in response to the signal supplied to the second input terminal, wherein the first signal processing circuit includes a second transistor connected between the second input terminal and the second node and a third transistor connected between the first power and the second node;

a second signal processing circuit that supplies a voltage of a second power to the first node in response to a signal supplied to a third input terminal and the voltage of the second node, wherein the second signal processing, circuit includes a fourth transistor and a fifth transistor connected in series with each other between the first node and the second power;

a first output circuit that outputs the signal supplied to the third input terminal based on the voltage of the first node and the voltage of the second node as a first scan signal from a first output terminal between two transistors of the first output circuit in series with each other;

a second output circuit that outputs a signal supplied to a fourth input terminal based on the voltage of the first node and the voltage of the second node as a second scan signal from a second output terminal between two transistors of the second output circuit in series with each other, wherein the second scan signal is output at a different time from the first scan signal.

12. The display device of claim 11, wherein the second input terminal is provided with a first clock signal, the third input terminal is provided with a second clock signal, and the fourth input terminal is provided with a third clock signal, and gate-on levels of the first clock signal, the second clock signal, and the third clock signal are not overlapped with each other.

13. The display device of claim 12, wherein the first transistor of the input circuit has a gate electrode connected to the second input terminal, and wherein the second transistor of the first signal processing circuit has a gate electrode connected to the first node; and the third transistor of the first signal processing circuit has a gate electrode connected to the second input terminal.

14. The display device of claim 13, wherein the second signal processing circuit further comprises:

a first capacitor connected between the second node and the second power, a gate electrode of the fourth transistor is connected to the second node, and a gate electrode of the fifth transistor is connected to the third input terminal.

15. The display device of claim 14, wherein the first output circuit comprises:

a sixth transistor connected between the first node and a third node, wherein the sixth transistor has a gate electrode connected to the first power;

a seventh transistor connected between the third input terminal and the first output terminal, wherein the seventh transistor has a gate electrode connected to the third node;

an eighth transistor connected between the first output terminal and the second power wherein the eighth transistor has a gate electrode connected to the second node; and a second capacitor connected between the third node and the first output terminal, wherein the seventh and eighth transistors are the two transistors of the first output circuit connected in series with each other.

16. The display device of claim 15, wherein the second output circuit comprises:

a ninth transistor connected between the first node and a fourth node, wherein the ninth transistor has a gate electrode connected to the first power;

a tenth transistor connected between the fourth input terminal and the second output terminal, wherein the tenth transistor has a gate electrode connected to the fourth node;

an eleventh transistor connected between the second output terminal and the second power, wherein the eleventh transistor has a gate electrode connected to the second node; and a third capacitor connected between the fourth node and the second output terminal, wherein the tenth and eleventh transistors are the two transistors of the second output circuit connected in series with each other.

17. The display device of claim 12, wherein the first input terminal of a first stage of the stages is provided with a start pulse and the first input terminal of each of remaining stages of the stages is provided with the second scan signal of a previous stage.

18. The display device of claim 12, wherein the second scan signal is shifted with respect to the first scan signal.

19. A scan driver, comprising:

a stage that comprises a first output circuit and a second output circuit, wherein the first output circuit comprises:

a first transistor connected between a first node and a third node, wherein the first transistor has a gate electrode connected to a first power;

a second transistor connected between a first clock terminal and a first output terminal, wherein the second transistor has a gate electrode connected to the third node; and a third transistor connected between the first output terminal and a second power, wherein the third transistor has a gate electrode connected to a second node, wherein the second output circuit comprises:

a fourth transistor connected between the first node and a fourth node, wherein the fourth transistor has a gate electrode connected to the first power;

a fifth transistor connected between a second clock terminal and a second output terminal, wherein the fifth transistor has a gate electrode connected to the fourth node; and a sixth transistor connected between the second output terminal and the second power, wherein the sixth transistor has a gate electrode connected to the second node, wherein the first output circuit is configured to output a first scan signal to the first output terminal at a first time and the second output circuit is configured to output a second scan signal to the second output terminal at a second time different from the first time.

20. The scan driver of claim 19, wherein the first clock terminal is supplied with a first clock signal and the second clock terminal is supplied with a second clock signal, wherein a low level of the first clock signal and a low level of the second clock signal do not overlap.

* * * * *